United States Patent [19]

Meyerhoefer et al.

[11] 4,224,955

[45] Sep. 30, 1980

[54] SHEATH FOR TEMPERATURE SENSING UNIT

[75] Inventors: Carl E. Meyerhoefer, Little Neck; Carl H. Meyerhoefer, Huntington Station, both of N.Y.

[73] Assignee: Revlon, Inc., New York, N.Y.

[21] Appl. No.: 9,923

[22] Filed: Feb. 7, 1979

[51] Int. Cl.[3] ..... A45D 2/12
[52] U.S. Cl. ..... 132/33 R
[58] Field of Search ..... 132/48, 46, 33

[56] References Cited

U.S. PATENT DOCUMENTS

| | | | |
|---|---|---|---|
| 2,201,719 | 5/1940 | Eicher | 132/46 R |
| 3,101,726 | 8/1963 | Catania | 132/46 R X |

*Primary Examiner*—G. E. McNeill
*Attorney, Agent, or Firm*—Leon E. Tenenbaum

[57] ABSTRACT

A sheath for holding a temperature sensing unit in place in the hair wrapped around a curling rod, comprising a top elongated channel portion, a pair opposed downwardly and outwardly projecting curved wings connected to the channel, the radius of curvature of the wings increasing with the distance from the channel and a hollowed out portion below the channel.

1 Claim, 5 Drawing Figures

FIG. 4
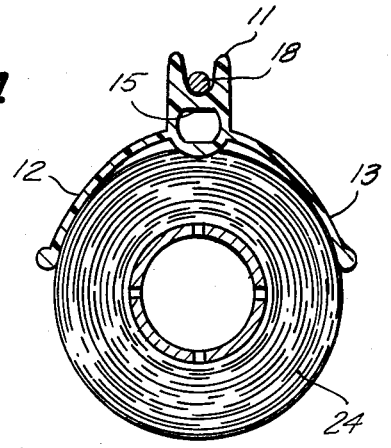
FIG. 2
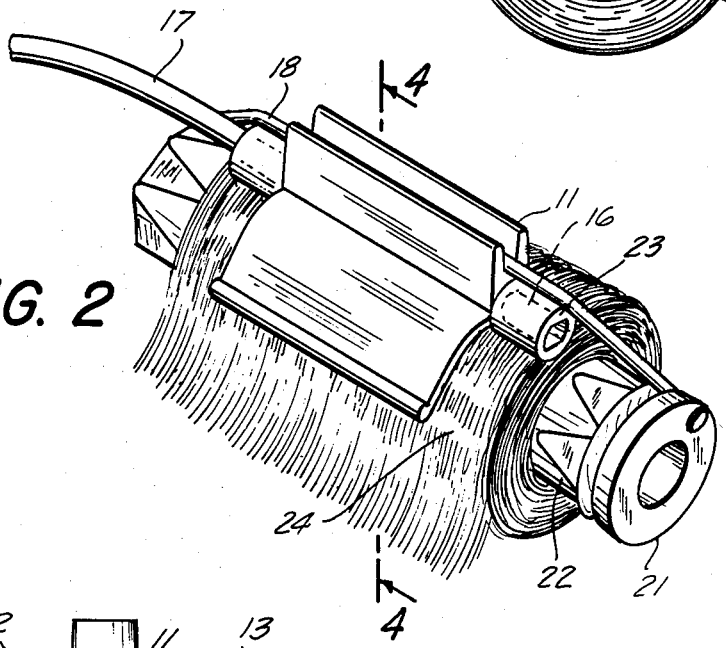
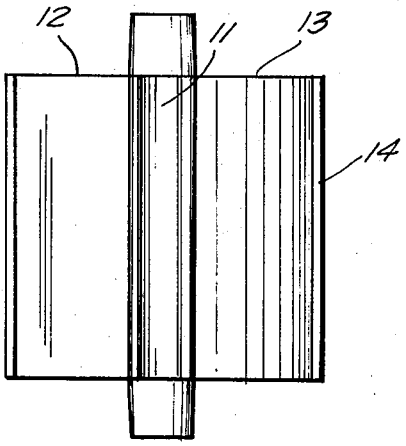
FIG. 5

SHEATH FOR TEMPERATURE SENSING UNIT

The present invention relates to permanent waving. It particularly relates to means for securing a temperature sensing device to curling rods for use in regulating the temperature of the hair in permanent waving.

In our U.S. Pat. No. 4,124,034, we described a temperature sensing device comprising a thermistor, a cable connecting the thermistor to a time-temperature control device and means for securing the termistor to a curling rod. These securing means comprised a sheath of a plastic material covering the thermistor and cable and a hook secured to the sheath by means of a sleeve covering the portion of the hook in contact with the sheath. The hook was inserted into a hole in a plug which fitted into an opening in the curling rod.

These hook-securing means were suitable for use with the curling rods in common use at the time the application on which the above-identified patent issued was filed; such curling rods, as shown in the drawings in the patent, being slim relative to their length. The heretofore described securing means are not, however, suitable for attachment to the large variety of curling rods now being used, particularly those which are of a diameter larger than in the thin-bodied rods shown in the patent. Besides, the presently available units, because of their relatively small surface area in contact with the hair, exert undue pressure on a small surface area of the hair thereby tending to leave an impression on the curl. This is particularly objectionable with the presently popular loose, flowing waves.

It is, accordingly, an object of the present invention to provide means for securing temperature sensing units to curling rods which means can be used with any curling rod regardless of its size and shape.

It is another object of the present invention to provide securing means which do not require the use of a hook to hold the securing means in place.

It is a further object of the present invention to provide a larger area for the surface contact between the temperature sensing unit and the hair thereby distributing the pressure exerted by the unit on the curls.

Other objects, features and advantages of the present invention will appear from the specification and claims when considered in connection with the accompanying drawings in which:

FIG. 2 is a perspective view similar to FIG. 1, with a curling rod having a diameter larger than the diameter of the curling rod in FIG. 1.

FIG. 4 is a sectional view along the line 4—4 of FIG. 2.

FIG. 5 is a top plan view of the sheath.

Figure 1:
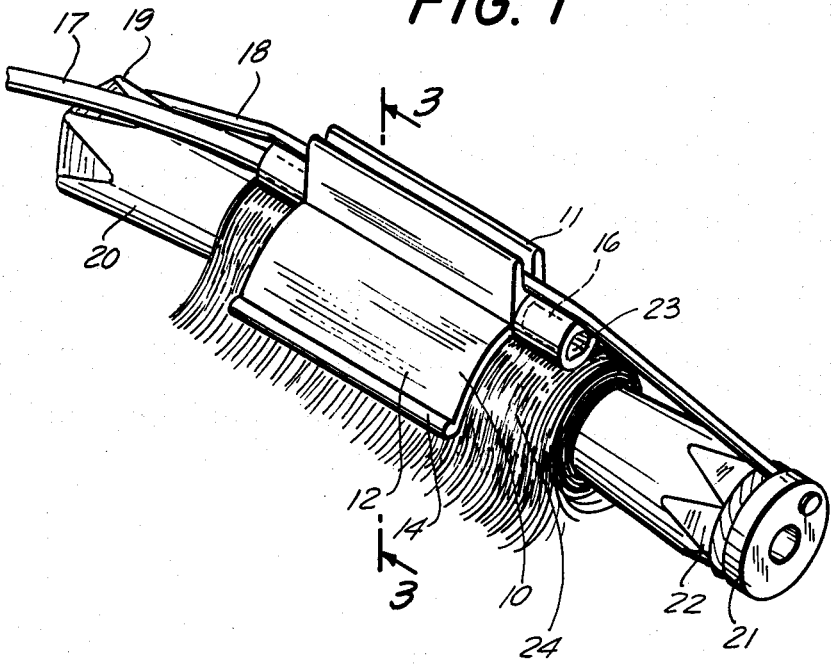
FIG. 1 is a perspective view of the novel sheath of the present invention along with a temperature sensing device and curling rod around which hair has been wound.
Figure 3:
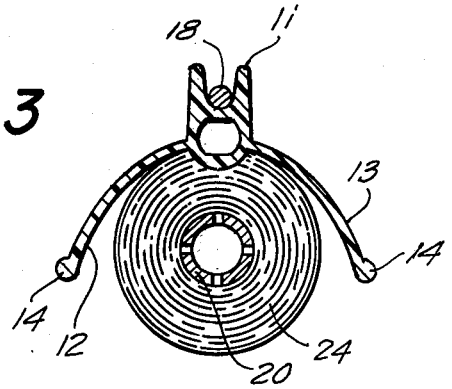
FIG. 3 is a sectional view along the line 3—3 of FIG. 1.

Referring to the drawings which illustrate a preferred embodiment of the present invention, numeral 10 generally refers to the sheath which is comprised of a top elongated channel portion 11 to which are integrally attached a pair of opposed downwardly and outwardly projecting curved wings 12 and 13 whose radius of curvature increases as the wings project outwardly from the channel portion. This increase in the radius of curvature serves to prevent the wing sections of the sheath from pressing against the hair and thereby marring the appearance of the hair when curling rods of larger diameter are used. The outer edges 14 of the wings may, if desired, be rounded or otherwise smoothed for ease in handling. Directly underneath the channel the sheath is a hollowed out portion 15 to provide a space for a temperature sensing unit 16, such as a thermistor, which is joined to a cable 17 leading to a time-temperature regulator. An elastic 18 attached to one end 19 of a curling rod 20 passes through the channel 11 and is secured at its other end to a plug 21 which can be inserted into the opposite end 22 of the curling rod. When the elastic is set in place it presses down on the sheath which in turn presses the front end 23 of the temperature sensing unit into the hair 24 thereby resulting in intimate contact with the hair and sensitive temperature measurements.

The sheath may be made of any material which is resistant to the action of alkali. Suitable materials include linear polyethylene and polypropylene. These materials may be molded into the desired shape using standard molding techniques.

We claim:

1. In a sheath to hold a temperature sensing unit in place in hair wrapped around a curling rod, said sheath comprising a top elongated channel portion, a pair of opposed downwardly and outwardly projecting curved wings integrally connected to said channel, and a hollowed portion below the channel, the improvement wherein the radius of curvature of said wings increases with the distance from the channel.

* * * * *